United States Patent [19]

Takashima et al.

[11] Patent Number: 4,487,642

[45] Date of Patent: Dec. 11, 1984

[54] METHOD OF PRODUCING MOISTURE-PERMEABLE ARTIFICIAL LEATHER

[75] Inventors: Katsuhiko Takashima, Sennan; Katsuhiro Moriwaki; Koichi Taniguchi, both of Osaka, all of Japan

[73] Assignee: Toyo Cloth Co., Ltd., Sennan, Japan

[21] Appl. No.: 502,846

[22] Filed: Jun. 9, 1983

[30] Foreign Application Priority Data

Jan. 24, 1983 [JP] Japan ..... 58-10393

[51] Int. Cl.[3] ..... B32B 5/18; B32B 31/00; B44C 3/00; C09J 1/00

[52] U.S. Cl. ..... 156/77; 156/155; 156/231; 156/249; 156/331.7; 428/904; 428/317.9

[58] Field of Search ..... 156/77, 231, 235, 239, 156/249, 246, 61, 289, 331.7, 344, 155; 264/49; 428/904, 425.9, 307.7, 317.9; 427/245, 373

[56] References Cited

U.S. PATENT DOCUMENTS

| | | | |
|---|---|---|---|
| 3,496,042 | 2/1970 | Wyness | 156/77 |
| 3,619,315 | 11/1971 | Carrach et al. | 156/77 |
| 3,650,880 | 3/1972 | Tieniber | 156/231 |
| 3,716,502 | 2/1973 | Loew | 264/49 |
| 3,770,537 | 11/1973 | Elton | 156/77 |
| 3,912,840 | 10/1975 | Edberg | 428/85 |
| 3,968,292 | 7/1976 | Pearman et al. | 428/213 |
| 4,116,741 | 9/1978 | Thoma et al. | 156/239 |
| 4,171,391 | 10/1979 | Parker | 427/246 |
| 4,308,184 | 12/1981 | Thoma et al. | 260/29.2 TN |

FOREIGN PATENT DOCUMENTS

| | | |
|---|---|---|
| 6026076 | 3/1981 | Japan . |
| 7066186 | 4/1982 | Japan . |

*Primary Examiner*—Michael Wityshyn
*Assistant Examiner*—Louis Falasco
*Attorney, Agent, or Firm*—Millen & White

[57] ABSTRACT

This invention relates to a method of producing a moisture-permeable artificial leather comprising transferring a water-soluble inorganic salt-containing polyurethane layer onto a base fabric and washing the polyurethane layer with water to extract out said water-soluble inorganic salt. A feature of the invention is that the inorganic salt used has a particle diameter range such that at least 90% thereof is not larger than 30 microns.

5 Claims, No Drawings

METHOD OF PRODUCING MOISTURE-PERMEABLE ARTIFICIAL LEATHER

BACKGROUND OF THE INVENTION

1. Field of the Invention

The present invention relates to a method of producing moisture-permeable artificial leather and, more particularly, to a method of producing a moisture-permeable artificial leather comprising transferring a water-soluble inorganic salt-containing polyurethane layer onto a base fabric and washing the polyurethane layer with water to extract out said water-soluble inorganic salt.

2. Prior Art

Many different methods have been proposed for the production of moisture-permeable artificial leather. We previously developed a method of producing a moisture-permeable artificial leather comprising coating a surface-forming composition consisting of a one-component polyurethane, a water-soluble inorganic salt and an organic solvent on a release material, then evaporating the organic solvent from said composition, applying thereon a base fabric through an adhesive layer comprising a water-soluble inorganic salt, peeling off the release material from said surface layer and immersing the composite sheet in water to extract out the water-soluble inorganic salt from the two layers (Japanese Patent Kokai No. Sho-57-66186). We conducted a further study on the above method and found that the above surface layer-forming composition and adhesive layer-forming composition are mere admixtures of the water-soluble inorganic salt with the rest of the composition and, therefore, the water-soluble inorganic salt is not uniformly distributed in the compositions so that when the surface layer-forming composition is applied to the release material, streaks are produced in the surface layer to detract from the surface appearance of the product leather and the surface of the adhesive layer is also streaked to cause a decrease in adhesive strength. Furthermore, the resistance of the leather to flexure, abrasion, scratching, water and dry cleaning was also not as high as would be desired.

Aside from the foregoing, there is also known a moisture-permeable, water-proof coated fabric (Japanese Patent Kokai No. Sho-56-26076) having a microporous polyurethane skin layer at least on one side of a base fabric and possessing a water proofness of at least 700 mm $H_2O/cm^2$ and a moisture permeability of at least 24 hours at 5000 $g/m^2$. However, this prior art is a wet-coagulation system wherein the polyurethane layer coated on the base fabric is coagulated in water and the product obtainable thereby has the disadvantage of rough surface, inadequate flexibility, interlayer separation and poor color quality and is unsuited particularly for clothing purposes.

It is an object of this invention to provide an improved method over the technology for the production of artificial leather. More particularly, this invention provides an improved technology for manufacturing an artificial leather with improved surface qualities and increased resistance to flexure, abrasion, scratching, laundering and dry cleaning.

DETAILED DESCRIPTION OF THE INVENTION

This invention relates, in one aspect, to a method of producing a moisture-permeable artificial leather comprising coating a release sheet material with a surfacing composition consisting of a hot laminating polyurethane, a water-soluble inorganic salt in a particle diameter range such that at least 90 percent thereof is not less than 30 microns, and an organic solvent, superimposing a base fabric on the surface layer so produced, heating the entire assembly, removing said release sheet, and immersing the resulting composite sheet to extract out said water-soluble inorganic salt.

In another aspect, the present invention relates to a method of producing a moisture-permeable artificial leather comprising coating a release sheet material with a surfacing composition containing a one-component polyurethane in an organic solvent, evaporating said organic solvent to provide a surface layer, superimposing a base fabric on said surface layer through an adhesive layer consisting of a two-component polyurethane and a water-soluble inorganic salt in the same particle size range as above, removing said release sheet, and immersing the resulting composite sheet in water to extract out said water-soluble inorganic salt.

Referring to the above-mentioned first aspect of this invention, said hot laminating polyurethane is a polyurethane intermediate between a one-component polyurethane and a two-component polyurethane, may be either a polyester type polyurethane or a polyether type polyurethane, and is a polyurethane that can be thermally bonded to a base fabric sheet. In the second aspect of this invention, a one-component polyurethane is employed in the surface layer while a two-component polyurethane is used in the adhesive layer. All of these polyurethanes may be commercial products.

The water-soluble inorganic salt to be mixed with the polyurethane in the surface layer may for example be sodium sulfate, sodium bicarbonate, ammonium sulfate, ammonium bicarbonate, sodium chloride or the like. The appropriate amount of such inorganic salt is 50 to 400 weight parts to each 100 weight parts of the polyurethane in the surface layer. If the amount is less than 50 wt. parts, the moisture-permeability of the final artificial leather will not be as high as desired, while an excess of the inorganic salt over 400 wt. parts will give an increased moisture-permeability but result in a roughened surface and a decreased resistance to water. One of the important features of the present invention lies in the definition that at least 90 percent of the water-soluble inorganic salt in the surface layer has particle diameters not larger than 30 microns and preferably not larger than 20 microns. If the particle size of 90% or more of the water-soluble inorganic salt exceeds 30 microns, the salt tends to precipitate and detract from the stability of the solution. Thus, if a surfacing composition containing such an inorganic salt is employed, streaks will be produced on the surface of the coat which reduce its adhesive affinity for the base fabric sheet. Moreover, the surface strength, water resistance and dry cleaning resistance of the product will be adversely affected. To ensure the above-mentioned size range for the water-soluble inorganic salt, it is preferable to add the requisite amount of said water-soluble inorganic salt to a portion of the polyurethane employed to form the surface layer, milling the mixture in a high-viscosity dispersing machine, a ball mill or the like for at least 36 hours to give a concentrated dispersion containing said water-soluble inorganic salt in the size range not exceeding the above-mentioned range, and add the dispersion to the balance of the polyurethane.

The surfacing composition may contain a colorant, an accelerator and other additives. The viscosity of the surfacing composition to be applied to the release sheet is preferably within the range of 3000 to 8000 cps. and can be adjusted with a diluent solvent or the like.

The release materials that can be employed according to this invention include plastic sheets such as sheets of polyethylene terephthalate, polyethylene, nylon, etc. and other release materials such as mold release paper. A release paper of silicone type is preferable for the second aspect of this invention, while a sheet of silicone type, polypropylene type or alkyd resin type is desirable for practicing the second aspect of this invention, although these are mentioned for illustrative purposes only and are not limitative of the invention.

Application of the above-mentioned surfacing composition is preferably effected using a roll coater, for instance. The deposition amount of the surfacing composition is 60 to 250 g/m$^2$ and, preferably, 100 to 200 g/m$^2$.

In the first aspect of this invention, after application of the surfacing composition to the release sheet, the organic solvent in the surfacing composition is evaporated by heating at 60° to 100° C. for 0.5 to 2 minutes, whereby a surface layer is formed on the release sheet. Then, a base fabric is superimposed on the surface layer and the assembly is pressed by a heating cylinder and a cooperating rubber roller to provide an integral sheet. This thermal pressing operation is preferably conducted at a temperature of 90° to 140° C. and a pressure of 1 to 4 kg/cm$^2$. The base fabric is preferably a woven fabric, a knitted fabric or a nonwoven fabric, and may be made of natural fiber, regenerated cellulose fiber or synthetic fiber.

In the second aspect of this invention, after application of the surfacing composition to the release material and subsequent heating under the above heating conditions to evaporate the organic solvent to give a surface layer, said adhesive layer composition is coated on the surface layer, then a base fabric sheet is superimposed on the adhesive layer thus formed, followed by curing to give an integral product. The adhesive layer composition is a solution of a two-component polyurethane, i.e. an isocyanate-terminated urethane prepolymer, and a water-soluble inorganic salt having the same particle size as mentioned above in an organic solvent, and the proportion of the water-soluble inorganic salt is similar to the proportion stated hereinbefore. After the base fabric is superimposed on the adhesive layer, the assembly is heated to evaporate the solvent from the adhesive layer and, then, a curing reaction is conducted at 120° to 150° C. for 1 to 3 minutes, whereby the base fabric is bonded to said surface layer through said adhesive layer.

In the foregoing first and second aspects of this invention, after the direct or indirect bonding of the base fabric to the surface layer, the release sheet is removed from the surface layer and the resulting composite sheet is immersed in water to extract the water-soluble inorganic salt. The preferred conditions of aqueous immersion are 40° to 70° C. water temperature and 20 to 120 immersion time.

The following examples are further illustrative but by no means limitative of this invention.

EXAMPLE 1

A one-component polyurethane (Leathermin ® ME-75, Dainichi Seika Co., Ltd.), a water-soluble inorganic salt and dimethylformamide in the proportions indicated below in Table 1 were admixed in a high-viscosity dispersing machine for 36 hours to prepare the high viscosity dispersions A and B indicated in Table 1. The high-viscosity dispersion C in Table 1 is a control (comparison) dispersion with large particle diameters and a large particle size distribution as prepared by using a mixing time of 2 hours.

TABLE 1

| High-viscosity dispersion | | A | B | C |
|---|---|---|---|---|
| One-component polyurethane | | 10 | 10 | 10 |
| Dimethylformamide | | 30 | 40 | 30 |
| Sodium sulfate | | 60 | — | 60 |
| Sodium bicarbonate | | — | 50 | — |
| Particle size | <20μ | 100 | 70 | 0 |
| dispersion | 20–30μ | 0 | 30 | 30 |
| (%) | >30μ | 0 | — | 70 |

Each of the above high-viscosity dispersions was mixed with a hot laminating polyurethane composition of Table 2 to prepare a surfacing composition, which was then coated on a silicone type release paper in a coating amount of 180 g/m$^2$ using a roll coater. The coat was dried at 70° C. for 1.5 minutes to give a surface layer. Then, a woven polyester fabric (weight 80 g/m$^2$) was superimposed on this surface and the two components were hot-laminated by means of a heating cylinder having a surface temperature of 120° C. and a cooperating rubber roller at a pressure of 3 kg/cm$^2$, followed by curing at 140° C. for 2 minutes. The release paper was peeled off the surface layer to leave a composite sheet consisting of the surface layer and base fabric. This composite sheet was immersed in warm water at 60° C. for 45 minutes to extract the water-soluble inorganic salt and dried to give an artificial leather. Physical properties of this artificial leather are shown in Table 3.

TABLE 2

| Example No. | | 1 | 2 | 3 | 4 | 5 | Comparison Example 1 |
|---|---|---|---|---|---|---|---|
| High viscosity dispersion | Type | A | B | A | A | A | C |
| | Amount | 150 | 150 | 70 | 150 | 150 | 150 |
| Hot laminating polyurethane | | 100 | 100 | 100 | 100 | 100 | 100 |
| Toluene | | 70 | 70 | 60 | 70 | 70 | 70 |
| Dimethylformamide | | 100 | 100 | 90 | 100 | 100 | 100 |
| Colorant | | 20 | 20 | 20 | 20 | 20 | 20 |
| Accelerator | | 4 | 4 | 4 | 4 | 4 | 4 |
| Silica powder | | | | | | 2 | |
| Foaming agent | | | | | 20 | | |
| Viscosity (cps.) | | 5000 | 5000 | 5000 | 5000 | 5000 | 5000 |

In Table 2, the hot laminating polyurethane is Crysbon OCS-45 (Dainippon Ink and Chemicals Inc.), the accelerator is Accel ® TS-1 (Dainippon Ink and Chemicals Inc.), the silica powder is Aerosil ® (Degussa, West Germany), and the foaming agent is Cellmike ® CAP (Sankyo Kasei, K.K.).

TABLE 3

| Example No. | 1 | 2 | 3 | 4 | 5 | Comparative Example 1 |
|---|---|---|---|---|---|---|
| Coating streaks | None | None | None | None | None | Streaked |
| Adhesive strength (peel) | Good | Good | Good | Good | Good | 350 |
| Flexural strength (peel) | Good | Good | Good | Good | Good | Peeled |
| Abrasion resistance (cycles/0.45 kg) | 10000< | Same as left | Same as left | Same as left | Same as left | 4000 |
| Water-proofness (mm) | 500 | 400 | 900 | 450 | 1250 | 50 |
| Resistance to dry cleaning | Good | Good | Good | Good | Good | Peeled |
| Resistance to laundering | Good | Good | Good | Good | Good | Peeled |
| Moisture permeability ($g/m^2$24 hrs.) | 3400 | 3500 | 3000 | 3300 | 3000 | 3500 |

In Table 3, coating streaks were evaluated by the naked eye; adhesive strength and felxural strength were measured in accordance with JIS K6772 and expressed in g/cm and 1000 cycles/kg, respectively; abrasion resistance and water resistance were measured in accordance with JIS L1004 and JIS L1079, respectively; resistance to dry cleaning was evaluated by cleaning each sample in a dry cleaning tester using a petroleum type detergent for 50 minutes and, after drying in the air, examining the surface layer for possible peeling by the naked eye; and resistance to laundering and moisture permeability were determined in accordance with JIS L1018 H and JIS L0208, respectively.

EXAMPLE 2

A two-component polyurethane (Leathermin ® UD660-SA, Dainichi Seika Co., Ltd.), sodium sulfate and ethyl acetate in the weight part proportions indicated below in Table 4 were admixed in a ball mill for 48 hours to prepare a high-viscosity dispersion D for an adhesive layer. The high-viscosity dispersion in Table 4 is a comparison example with large particle diameters and a large particle size distribution as prepared by using a mixing time of 2 hours.

TABLE 4

| (for an adhesive layer) High-viscosity dispersion | | D | E |
|---|---|---|---|
| Two-component polyurethane | | 10 | 10 |
| Ethyl acetate | | 50 | 30 |
| Sodium sulfate | | 40 | 60 |
| Particle size distribution | ≦30μ | 90 | 15 |
| (%) | >30μ | 10 | 85 |

The high-viscosity dispersion A according to the first aspect of this invention was mixed with the same one-component polyurethane composition to prepare a surfacing composition (Table 5) which was then coated on a polypropylene type release paper in a coating amount of 90 $g/m^2$ using a roll coater and dried at 100° C. for 1 minute to give a surface layer. Then, the above high-viscosity dispersion for an adhesive layer was mixed with the same two-component polyurethane composition to prepare an adhesive composition of Table 5. This adhesive composition was coated on the above-mentioned surface layer in a coating amount of 90 $g/m^2$ using a roll coater and dried at 80° C. for 1 minute to give an adhesive layer. Then, a cotton fabric (weight 80 $g/m^2$) was superimposed on this adhesive layer, followed by curing at 60° C. for 24 hours. The release paper is then peeled off the surface layer. The resulting composite sheet consisting of the base fabric, adhesive layer and surface layer was immersed in warm water at 50° C. for 1 hour to extract the sodium sulfate and, then, dried to give an artificial leather. Physical properties of this artificial leather are shown in Table 6.

TABLE 5

| Example No. | | 6 | Comparison Example 2 |
|---|---|---|---|
| Surface layer | | | |
| High-viscosity dispersion | Type | A | A |
| | Amount | 350 | 350 |
| One-component polyurethane | | 100 | 100 |
| Dimethylformamide | | 150 | 150 |
| Methyl ethyl ketone | | 150 | 150 |
| Colorlant | | 40 | 40 |
| Adhesive layer | | | |
| High-viscosity dispersion | Type | D | E |
| | Amount | 300 | 300 |
| Two-component polyurethane | | 100 | 100 |
| Dimethylformamide | | 20 | 20 |
| Toluene | | 70 | 70 |
| Cross-linking agent | | 20 | 20 |
| Accelerator | | 13 | 13 |

The cross-linking agent and accelerator in the adhesive composition of Tablex 5 are Leathermin ® UD cross-linking agent (Dainichi Sika Co., Ltd.) and Accel ® HI-101 (Dainippon Ink and Chemicals Inc.), respectively.

TABLE 6

| Example No. | 1 | Comparative Example 2 |
|---|---|---|
| Coating streaks | None | Streaked |
| Adhesive strength (peel) | Good | 350 |
| Flexural strength (peel) | Good | Peeled |
| Abrasion resistance (cycles/0.45 kg) | 10000< | 5000 |
| Water-proofness (mm) | >1500 | Same as left |
| Resistance to dry cleaning | Good | Peeled |
| Resistance to laundering | Good | Peeled |
| Moisture permeability ($g/m^2$24 hrs.) | 3400 | 2400 |

It will be apparent from Table 3 (Example 1) and Table 6 (Example 2) that the artificial leathers provided by this invention are free from surface streaks and have improved performance characteristics in the parameters of adhesive strength, flexural strength, water proofness, and resistance to laundering and dry cleaning, with the moisture permeability being fully retained. Moreover, the moisture permeability and water-proofness of these leathers are substantially not affected by repeated dry cleaning or laundering. Moreover, as shown in Example 5 for the first aspect of this invention, the addition of aerosil results in a remarkable improvement in water-proofness. These beneficial results are materialized by the use of a water-soluble inorganic salt in a particle size distribution such that at least 90 percent thereof are not more than 30 microns in the polyurethane-based surfacing composition and in the adhesive composition.

What is claimed is:

1. In a method of producing moisture-permeable artificial leather which comprises the steps of coating a release sheet with a dispersion of finely divided particles of a water-soluble inorganic salt in a polyurethane solution in an organic solvent; removing the solvent from the resulting film to provide a surface layer; bonding a base fabric onto said surface layer; removing said release sheet; and leaching said particles of said inorganic salts from said surface layer, the improvement wherein said dispersion is prepared by the steps of milling a mixture of said particles and a solution of a one-component polyurethane in said solvent until at least 90% of said particles have a particle size of not greater than 30 microns, and then thoroughly blending the thus-produced premix with a solution, free of said particles, of a hot laminating polyurethane in said solvent to form said dispersion; and wherein said base fabric and said surface layer are bonded together by pressing them under heat without any adhesive layer interposed therebetween, thereby producing an articficial leather suitable for clothing purposes with excellent surface appearance qualities, moisture permeability and wear resistance.

2. The method of claim 1 wherein said dispersion comprises silica powder.

3. The method of claim 1 wherein said mixture is milled in a high-viscosity dispersing machine for at least 36 hours.

4. The method of claim 1 wherein said inorganic salt is present in said dispersion in an amount from 50 to 400 parts by weight per 100 parts by weight of the polyurethane content thereof.

5. The method of claim 1 wherein said mixture is milled in a high-viscosity dispersing machine for at least 36 hours and wherein said inorganic salt is sodium sulfate or sodium bicarbonate and is present in said dispersion in an amount from 50 to 400 parts by weight per 100 parts by weight of the polyurethane content thereof.

* * * * *